US005471840A

United States Patent [19]

Lovett

[11] Patent Number: 5,471,840

[45] Date of Patent: Dec. 5, 1995

[54] BLUFFBODY FLAMEHOLDERS FOR LOW EMISSION GAS TURBINE COMBUSTORS

[75] Inventor: Jeffery A. Lovett, Scotia, N.Y.

[73] Assignee: General Electric Company, Schenectady, N.Y.

[21] Appl. No.: 270,292

[22] Filed: Jul. 5, 1994

[51] Int. Cl.[6] ..... F02C 3/14

[52] U.S. Cl. ..... 601/737; 60/749

[58] Field of Search ..... 60/725, 737, 738, 60/749, 261; 181/213; 431/114, 350

[56] References Cited

U.S. PATENT DOCUMENTS

| | | | |
|---|---|---|---|
| 3,601,985 | 8/1971 | Bauger | 431/114 |
| 3,944,142 | 3/1976 | Welden et al. | 239/552 |
| 4,223,615 | 9/1980 | Breen et al. | 110/264 |
| 4,397,631 | 8/1983 | Fisher | 431/114 |
| 4,587,809 | 5/1986 | Ohmori et al. | 60/748 |
| 4,589,260 | 5/1986 | Krockow | 60/748 |
| 5,129,226 | 7/1992 | Bigelow et al. | 60/261 |
| 5,218,824 | 6/1993 | Cederwall et al. | 60/737 |
| 5,259,184 | 11/1993 | Borkowicz et al. | 60/737 |
| 5,295,352 | 3/1994 | Beebe et al. | 60/737 |

*Primary Examiner*—Timothy S. Thorpe
*Attorney, Agent, or Firm*—Paul R. Webb, II

[57] ABSTRACT

Combustion-induced instabilities are minimized in gas turbine combustors with a plurality of flameholders disposed on the center hub of each fuel nozzle. The flameholders are streamlined bluffbodies oriented at an angle with respect to the longitudinal axis of the center hub which roughly matches the swirl angle of the fuel nozzle swirl vanes. The flameholders have streamlined upstream faces and flat downstream faces. The flat faces are preferably flush with the bluff end of the center hub. The flameholders, which are equally spaced about the circumference of the center hub, preferably block about 30–50% of the annular cross-sectional area in each burner. Thus, an array of additional flame sheets is produced in each burner without destroying the swirl. These additional flame sheets effectively increase early fuel consumption so that heat release in the main combustion chamber is decreased, thereby reducing combustion instabilities.

2 Claims, 2 Drawing Sheets

BLUFFBODY FLAMEHOLDERS FOR LOW EMISSION GAS TURBINE COMBUSTORS

This application is related to copending application entitled "V-shaped Flameholders for Low Emission Gas Turbine Combustors," Ser. No. 08/270,294, filed Jul. 5, 1994 and assigned to the same assignee as the present invention.

BACKGROUND OF THE INVENTION

This invention relates generally to gas turbine combustors and more particularly concerns reducing combustion instabilities in dry low $NO_x$ gas turbine combustors.

Gas turbines generally include a compressor, one or more combustors, a fuel injection system and a turbine. Typically, the compressor pressurizes inlet air which is then reverse flowed to the combustors where it is used to provide air for the combustion process and also to cool the combustors. In a multi-combustor system, the combustors are located about the periphery of the gas turbine, and a transition duct connects the outlet end of each combustor with the inlet end of the turbine to deliver the hot products of combustion to the turbine.

Gas turbine combustors are being developed which employ lean premixed combustion to reduce emissions of gases such as $NO_x$. One such combustor comprises a plurality of burners attached to a single combustion chamber. Each burner includes a flow tube with a centrally-disposed fuel nozzle comprising a center hub which supports fuel injectors and swirl vanes. During operation, fuel is injected through the fuel injectors and mixes with the swirling air in the flow tube, and a flame is produced at the exit of the burner. The combustion flame is stabilized by a combination of bluffbody recirculation behind the center hub and swirl-induced recirculation. Because of the lean stoichiometry, lean premixed combustion achieves lower flame temperatures and thus produces lower $NO_x$ emissions.

These premixed systems are susceptible to combustion instabilities in the form of strong, unsteady pressure oscillations in the main combustion chamber. The oscillations are believed to be caused by the turbulent nature of the combustion process and the large volumetric energy release within the closed cavities of the combustor. If not suppressed, the combustion instabilities will severely limit the operating range of the combustor and may even lead to fatigue failure of combustor hardware. Acoustic, energy-absorbing liners are conventionally used to suppress combustion oscillations. However, these liners require cooling air injection which is typically not available in low $NO_x$ combustors. Moreover, acoustic liners are costly and allow air leakage which may have an adverse impact on combustor performance and emission levels. Another method of reducing combustion oscillations involves spreading out the heat release, i.e., decoupling the heat release from the pressure antinode. However, this method is not compatible with low $NO_x$ combustors because the flame must be kept short and compact for low CO emissions.

Accordingly, there is a need to enhance the stability and operating range of premixed low $NO_x$ gas turbine combustors by reducing or eliminating high frequency combustion instabilities.

SUMMARY OF THE INVENTION

The above-mentioned needs are met by the present invention which provides a burner for a gas turbine combustor. The burner comprises a flow tube and a center hub disposed in the flow tube. Swirl vanes defining a swirl angle are disposed in the flow tube, and fuel injectors are disposed on the center hub. A plurality of bluffbody flameholders are disposed on the center hub near the downstream end of the center hub. Each one of the flameholders is oriented at an angle with respect to the longitudinal axis of the center hub which is substantially equal to the swirl angle. The flameholders have streamlined upstream faces and flat downstream faces. The flat downstream faces are preferably flush with the downstream end of the center hub. The bluffbody flameholders, which are equally spaced about the circumference of the center hub, preferably block about 30–50% of the cross-sectional area defined between the flow tube and the center hub. The flameholders extend outward about 60–80% of the span between the center hub and the flow tube.

In addition to reducing combustion instabilities, the flameholders of the present invention present only minimal hardware changes; thus, gas turbines can be easily retrofitted to include these bluffbody flameholders.

Other objects and advantages of the present invention will become apparent upon reading the following detailed description and the appended claims with reference to the accompanying drawings.

DESCRIPTION OF THE DRAWINGS

The subject matter which is regarded as the invention is particularly pointed out and distinctly claimed in the concluding part of the specification. The invention, however, may be best understood by reference to the following description taken in conjunction with the accompanying drawing figures in which:

DETAILED DESCRIPTION OF THE INVENTION

Figure 1:
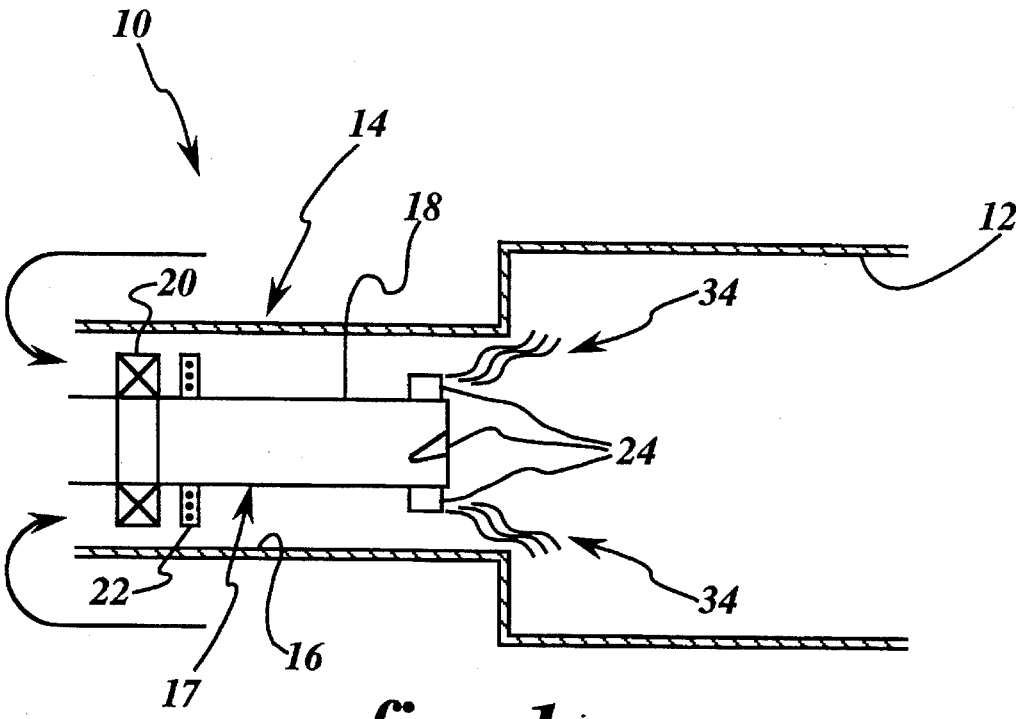
FIG. 1 is a schematic cross-sectional view of a gas turbine combustor in accordance with the present invention.

Referring to the drawings wherein identical reference numerals denote the same elements throughout the various views, FIG. 1 schematically shows a gas turbine combustor 10 of the present invention. The combustor 10 includes a main combustion chamber 12 and at least one burner 14 attached to the upstream end of the main combustion chamber 12. Compressed air enters the burner 14 from the left (as shown by the arrows in FIG. 1) and flows to the right through the combustor 10. As is well known in the art, the air is provided by a compressor (not shown) and is reversed flowed over the combustor 10 before entering the burner 14. While only one burner 14 is shown in FIG. 1 for clarity of illustration, it should be noted that a plurality of such burners is preferably used. Typically, five or six burners are arranged in a circular array on the upstream end of the main combustion chamber 12.

The burner 14 preferably comprises a cylindrical flow tube 16 having a fuel nozzle 17 disposed concentrically therein. The fuel nozzle 17 includes a cylindrical center hub 18 having a downstream bluff end which is recessed into the flow tube 16 with respect to the main combustion chamber 12. Typically, the bluff end of the center hub 18 is recessed by approximately 1–3 inches. A plurality of swirl vanes 20

(sometimes referred to collectively as a swirler) is mounted to the center hub 18, near the upstream end of the flow tube 16. The vanes 20, which define a swirl angle with respect to the longitudinal axis of the center hub 18, impart a swirling pattern to the air flowing through the flow tube 16. The swirl angle is typically in the range of about 30°–600°. Radial fuel injectors 22 for injecting fuel into the air flow are mounted on the center hub 18 slightly downstream of the swirl vanes 20. A plurality of bluffbody flameholders 24 is located downstream of the swirl vanes 20 and the fuel injectors 22. The bluffbody flameholders 24 are attached to the center hub 18 at or near the downstream end thereof, i.e., the end of the center hub 18 closest to the main combustion chamber 12.

Air flowing through the flow tube 16 is swirled by the swirl vanes 20. The swirling air passes over the fuel injectors 22 and mixes with the fuel released by the fuel injectors 22. The fuel-air mixture is burned near the exit of the flow tube 16. The flames are stabilized by a combination of bluffbody recirculation behind the flameholders 24 and the center hub 18 and swirl induced recirculation. The swirl vanes 20 and the fuel injectors 22 are disposed sufficiently upstream from the flow tube exit to allow the fuel and air to premix completely prior to combustion.

Figure 2:
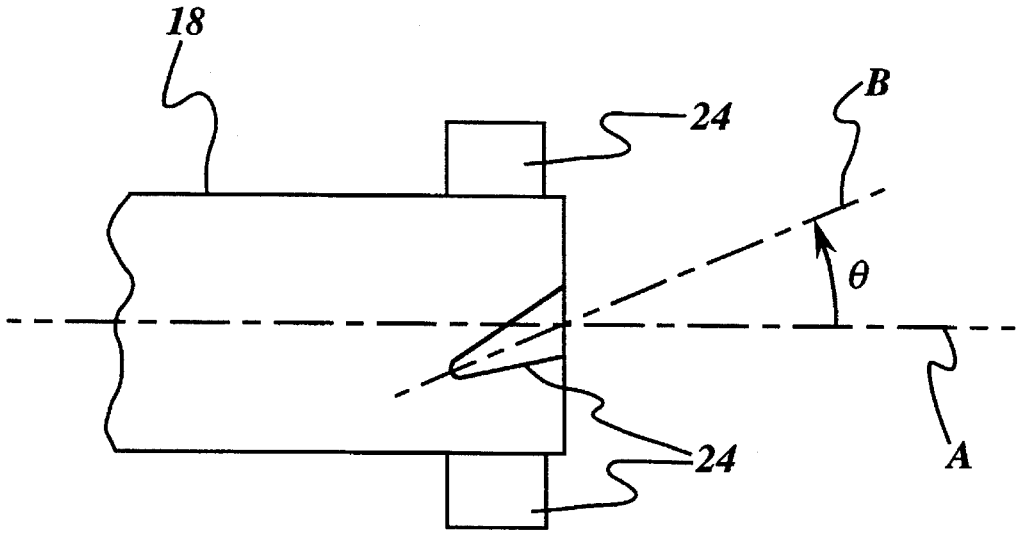
FIG. 2 shows a more detailed view of the bluffbody flameholders of the present invention.

The bluffbody flameholders 24 are blocks of a heat-resistant material attached along one edge to the outer cylindrical surface of the center hub 18 and extending radially outward toward the inner surface of the flow tube 16. As best seen in FIG. 2, the bluffbody flameholders 24 are provided with a wedge-shaped configuration so as to hold flames but to avoid flow separation which would expose the entire body to the flame and lead to burn off. Specifically, the upstream faces of the flameholders 24 are angled or streamlined, and the downstream faces are flat, preferably flush with the bluff end of the center hub 18. This wedge-shaped configuration also reduces the pressure drop produced by the bluffbody flameholders 24.

The bluffbody flameholders 24 are oriented on the center hub 18 at an angle θ with respect to the longitudinal axis A of the center hub 18. The angle θ is substantially equal to the swirl angle defined by the swirl vanes 20. Because the flameholders 24 are oriented along the swirl angle, they do not destroy the swirl and thus do not adversely affect stability of the burner 14. Thus, although the angle θ is preferably very close to the swirl angle, it does not need to exactly match the swirl angle to achieve the objective of preserving the swirl. Moreover, the flameholders 24 can even increase the swirl if the angle θ is greater than the swirl angle. As shown in FIG. 2, each flameholder 24 is oriented along the swirl angle by positioning its longitudinal axis B along the swirl angle. However, it is conceivable that the bluffbody flameholders 24 could be configured so as not to have a true longitudinal axis. In this case, the bluffbody flameholders 24 will be considered to be oriented along the swirl angle as long as there is some other axis of symmetry or surface thereof which lies at least approximately along the swirl angle.

The plural bluffbody flameholders 24 are preferably spaced equally about the circumference of the center hub 18. The optimum size and number of the bluffbody flameholders 24 for best reducing combustion instabilities will ultimately depend on the operating conditions of the particular combustor they are being used in. Preferably, the flameholders 24 will be sized so as to collectively block about 30–50% of the cross-sectional area of the annulus defined between the flow tube 16 and the center hub 18. As used herein, blockage of the annulus refers to the percent of the overall area in the annulus which is obstructed perpendicular to the flow direction. This means that for combustors of typical size, there will be about 3–6 flameholders 24 having a width in the range of about 0.25–0.75 inches. The bluffbody flameholders 24 preferably extend outward a distance sufficient to provide the desired amount of blockage but without coming so close to the inner wall of the flow tube 16 so as to expose the wall to flames. This distance is typically about 60–80% of the span between the center hub 18 and the flow tube 16, or about 0.5–1.0 inches for combustors of typical size.

Figure 3:
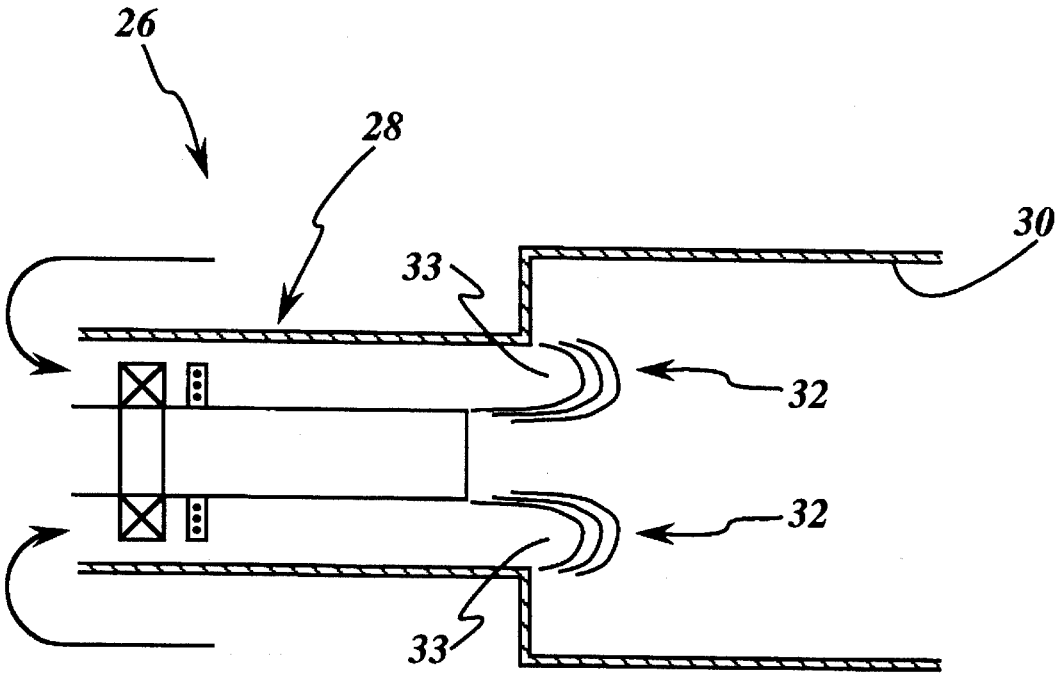
fig. 3 (PRIOR ART)
FIG. 3 shows the flame pattern in a conventional gas turbine combustor.

The effect produced by the bluffbody flameholders 24 can be seen by comparing FIG. 1 to FIG. 3 which shows the flame pattern in a conventional combustor 26 having a burner 28 and a main combustion chamber 30. The flames 32 created at the exit of the burner 28 extend into the main combustion chamber 30, creating a strong annular jet of unburned gases 33 in the main combustion chamber 30. The major extent of fuel consumption and heat release thus occurs well into the main combustion chamber 30 which leads to combustion instabilities. Referring to FIG. 1, it is shown that the bluffbody flameholders 24 produce an array of flame sheets 34 in the flow tube 16 without destroying the swirl. These additional flame sheets effectively increase fuel consumption inside the flow tube 16, before the main combustion chamber 12 is reached. Thus, the potential heat release in the main combustion chamber 12 is decreased, thereby reducing combustion instabilities. Ideally, the flame sheets 34 from each of the bluffbody flameholders 24 will merge prior to the main combustion chamber 12 so that there will be no pure unburned mixture available in the main combustion chamber 12 to promote instabilities.

The foregoing has described a modified fuel nozzle for gas turbines which reduces the generation of combustion instabilities. While specific embodiments of the present invention have been described, it will be apparent to those skilled in the art that various modifications thereto can be made without departing from the spirit and scope of the invention as defined in the appended claims.

What is claimed is:

1. A burner for a gas turbine combustor, said burner comprising:

a flow tube;

a center hub disposed in said flow tube, said center hub having a longitudinal axis, an upstream end and a downstream end;

swirl vanes disposed in said flow tube, said swirl vanes defining a swirl angle;

a plurality of flameholders disposed on said center hub, each one of said flameholders being oriented at an angle with respect to said longitudinal axis of said center hub which is substantially equal to said swirl angle; and each one of said plurality of flameholders has an outer radial surface located from said center hub a distance equal to about 60–80% of the span between said center hub and said flow tube.

2. A gas turbine apparatus comprising:

a main combustion chamber; and a plurality of burners attached to said main combustion chamber, each burner comprising:

a flow tube;

a center hub disposed in said flow tube, said center hub having a longitudinal axis, an upstream end and a downstream end; swirl vanes disposed in said flow tube, said swirl vanes defining a swirl angle;

a plurality of flameholders disposed on said center hub, each one of said flameholders being oriented at an angle with respect to said longitudinal axis of said center hub which is substantially equal to said swirl angle; and each one of said plurality of flameholders has an outer radial surface located from said center hub a distance equal to about 60–80% of the span between said center hub and said flow tube.

* * * * *